US011677196B2

(12) United States Patent
Tang et al.

(10) Patent No.: US 11,677,196 B2
(45) Date of Patent: Jun. 13, 2023

(54) BOARD-TO-BOARD RADIO FREQUENCY COAXIAL CONNECTOR

(71) Applicants: ROSENBERGER ASIA PACIFIC ELECTRONIC CO., LTD., Beijing (CN); PROSE TECHNOLOGIES LLC, Mount Olive, NJ (US)

(72) Inventors: Shen Tang, Beijing (CN); Chuanyi Hu, Beijing (CN); Dongxing Wu, Beijing (CN)

(73) Assignee: ROSENBERGER ASIA PACIFIC ELECTRONIC CO., LTD., Beijing (CN)

( * ) Notice: Subject to any disclaimer, the term of this patent is extended or adjusted under 35 U.S.C. 154(b) by 24 days.

(21) Appl. No.: 17/500,384

(22) Filed: Oct. 13, 2021

(65) Prior Publication Data

US 2022/0037840 A1 Feb. 3, 2022

Related U.S. Application Data

(63) Continuation of application No. PCT/CN2020/096374, filed on Jun. 16, 2020.

(30) Foreign Application Priority Data

Oct. 14, 2019 (CN) ..... 201921716460.9

(51) Int. Cl.
*H01R 24/54* (2011.01)
*H01R 13/03* (2006.01)
*H01R 103/00* (2006.01)

(52) U.S. Cl.
CPC ..... *H01R 24/542* (2013.01); *H01R 13/03* (2013.01); *H01R 2103/00* (2013.01)

(58) Field of Classification Search
CPC .... H01R 2103/00; H01R 24/40; H01R 24/50; H01R 24/542; H01R 24/38; H01R 13/03
(Continued)

(56) References Cited

U.S. PATENT DOCUMENTS 5,879,177 A * 3/1999 Honma ..... H01R 24/542 439/246
8,016,614 B2 * 9/2011 Xie ..... H01R 24/50 439/63

(Continued)

FOREIGN PATENT DOCUMENTS

CN 101330181 A 12/2008
CN 104901053 A 9/2015

(Continued)

OTHER PUBLICATIONS

The World Intellectual Property Organization (WIPO) International Search Report for PCT/CN2020/096374 dated Aug. 31, 2020 6 Pages (including translation).

*Primary Examiner* — Gary F Paumen
(74) *Attorney, Agent, or Firm* — Anova Law Group, PLLC

(57) ABSTRACT

A board-to-board radio frequency coaxial connector includes an adapter, a clamping socket including a first outer conductor, a first inner conductor, and a first insulator, and a fixed socket including a second outer conductor, a second inner conductor, and a second insulator. The clamping socket and the fixed socket are respectively arranged at two ends of the adaptor. The adapter includes a third outer conductor, a third inner conductor, and two third insulators. The two third insulators are respectively arranged at two ends of the third inner conductors and sleeved on an outside of the third inner conductor. Each of the two third insulators includes a body portion and an auxiliary portion. The body portion includes a second groove recessed inwardly from its (Continued)

outer circumferential surface. Two ends of the third outer conductor are respectively electrically connected to the first and second outer conductors.

11 Claims, 4 Drawing Sheets

(58) Field of Classification Search
USPC ..... 439/578, 63
See application file for complete search history.

(56) References Cited

U.S. PATENT DOCUMENTS

| | | | | |
|---|---|---|---|---|
| 8,888,527 | B2 * | 11/2014 | Chastain | H01R 24/545 439/578 |
| 2011/0117778 | A1 * | 5/2011 | Xie | H01R 24/44 439/578 |
| 2013/0102190 | A1 * | 4/2013 | Chastain | H01R 24/545 439/583 |
| 2015/0288084 | A1 * | 10/2015 | Shaw | H01R 24/542 439/578 |
| 2018/0124921 | A1 * | 5/2018 | Song | H05K 1/148 |

FOREIGN PATENT DOCUMENTS

| | | | |
|---|---|---|---|
| CN | 206893948 | U | 1/2018 |
| CN | 110994299 | A | 4/2020 |
| CN | 210326256 | U | 4/2020 |
| EP | 0793299 | A1 | 9/1997 |

* cited by examiner

BOARD-TO-BOARD RADIO FREQUENCY COAXIAL CONNECTOR

CROSS-REFERENCE TO RELATED APPLICATIONS

This application is a continuation of International Application No. PCT/CN2020/096374, filed Jun. 16, 2020, which claims priority to Chinese Application No. 201921716460.9, filed on Oct. 14, 2019, the entire contents of both of which are incorporated herein by reference.

TECHNICAL FIELD

The present disclosure generally relates to the electronic information and communication field, and more specifically, to a board-to-board radio frequency coaxial connector.

BACKGROUND

Currently, with the continuous development of wireless communication technology and the broad application of wireless communication, especially diversified development of mobile communication network standards and a miniaturized and highly integrated apparatus may become popular. Thus, a new technical indicator is proposed for an inter-board connector, which requires the inter-board connector to satisfy large axial and radial tolerances and low cost. At present, a variety of board-to-board radio frequency connection solutions exist on the market. For example, an axial offset and a radial offset of a board-to-board connector (MMBX) are ±0.7 mm and ±4.5°, respectively. These connectors may solve the axial and radial tolerance issues, but the cost of the product is high.

SUMMARY

Embodiments of the present disclosure provide a board-to-board radio frequency coaxial connector including an adapter, a clamping socket, and a fixed socket. The clamping socket is arranged at a first end of the adaptor and includes a first outer conductor, a first inner conductor, and a first insulator. The first inner conductor is arranged coaxially in the first outer conductor. The first insulator is arranged between the first inner conductor and the first outer conductor. The fixed socket is arranged at a second end of the adaptor and includes a second outer conductor, a second inner conductor, and a second insulator. The second inner conductor is arranged coaxially in the second outer conductor. The second insulator is arranged between the second inner conductor and the second outer conductor. The adapter includes a third outer conductor, a third inner conductor, and two third insulators. The third inner conductor is arranged coaxially in the third outer conductor. The two third insulators are arranged at two ends of the third inner conductors, respectively, and sleeved on an outside of the third inner conductor. The two third insulators are arranged coaxially with the third inner conductor and between the third inner conductor and the third outer conductor. The third insulator includes a body portion and an auxiliary portion. The body portion includes a second groove recessed inwardly from an outer circumferential surface of the body portion. A first through-hole is arranged between the body portion and the auxiliary portion. A second through-hole is arranged at a center of the body portion and extends axially. The third inner conductor is arranged in the second through-hole. The auxiliary portion is arranged around the body portion. Two ends of the third outer conductor are electrically connected to the first outer conductor and the second outer conductor, respectively. The two ends of the third inner conductor are electrically connected to the first inner conductor and the second inner conductor, respectively.

REFERENCE NUMERALS

| | | | | | |
|---|---|---|---|---|---|
| 2 | clamping socket; | 21 | first outer conductor; | 22 | sixth outer conductor; |
| 221 | guide surface; | 23 | first inner conductor; | 24 | first insulator; |
| 3 | fixed socket; | 31 | second outer conductor; | | |
| 32 | second inner conductor; | | | 33 | second insulator; |
| 4 | adapter; | 41 | third outer conductor; | 42 | third inner conductor; |
| 421 | middle portion; | 422 | two end parts; | 423 | second step; |
| 424 | tapered clamping portion; | | | 425 | cutout; |
| 43 | third insulator; | 431 | body portion; | 432 | auxiliary portion; |
| 433 | first through-hole; | 434 | second groove; | 435 | second through-hole; |
| 44 | fourth outer conductor; | | | 441 | first groove; |
| 442 | slope; | 45 | fifth outer conductor; | 451 | end portion; |
| 452 | extension portion; | 453 | first step; | 454 | protrusion; |
| 455 | notch. | | | | |

DETAILED DESCRIPTION OF THE EMBODIMENTS

The technical solution of embodiments of the present disclosure is described in detail in connection with accompanying drawings of embodiments of the present disclosure.

Figure 1:
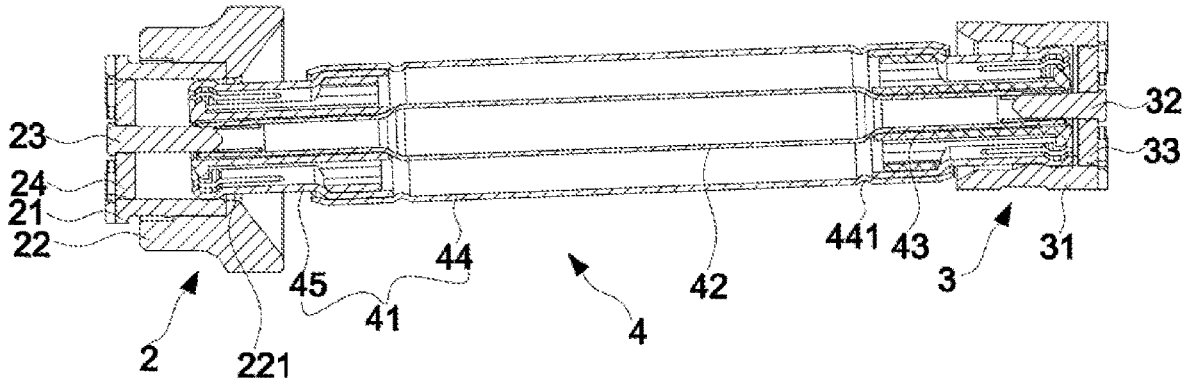
FIG. 1 is a schematic cross-sectional structural diagram of a board-to-board radio frequency coaxial connector according to some embodiments of the present disclosure.
Figure 2:
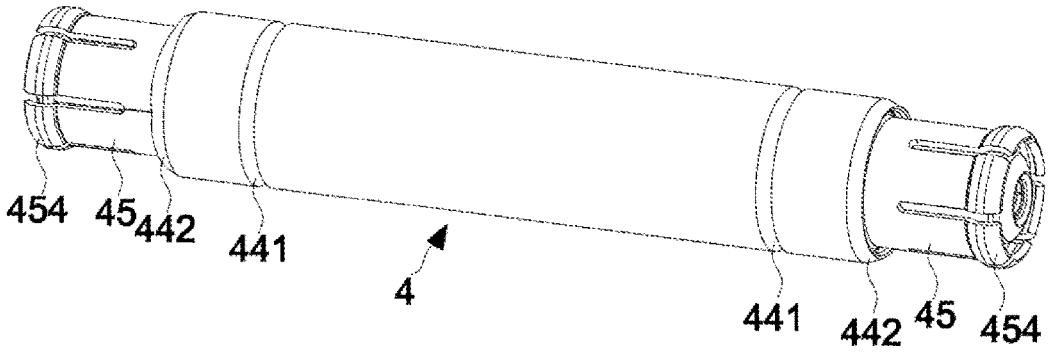
FIG. 2 is a schematic structural diagram of an adapter according to some embodiments of the present disclosure.
Figure 3:
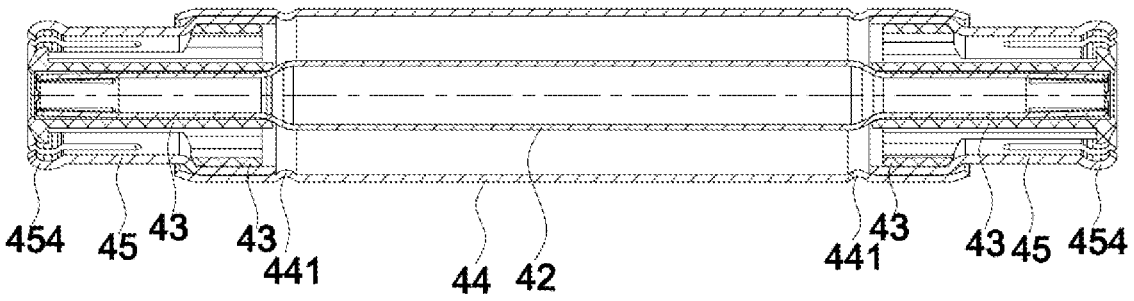
FIG. 3 is a schematic cross-sectional structural diagram of the adapter according to some embodiments of the present disclosure.

Referring to FIG. 1 to FIG. 3, a board-to-board radio frequency connector of embodiments of the present disclosure includes a clamping socket 2, a fixed socket 3, and an adapter 4. The clamping socket 2 and the fixed socket 3 may be arranged at two ends of the adapter 4, respectively.

The clamping socket 2 may include a first outer conductor 21, a sixth outer conductor 22, a first inner conductor 23, and a first insulator 24. The first outer conductor 21 may be coaxially arranged in the sixth outer conductor 22. The first inner conductor 23 may be coaxially arranged in the first outer conductor 21. The first insulator 24 may be arranged between the first outer conductor 21 and the first inner conductor 23.

The fixed socket 3 may include a second outer conductor 31, a second inner conductor 32, and a second insulator 33. The second inner conductor 32 may be coaxially arranged in the second outer conductor 31. The second insulator 33 may be arranged between the second outer conductor 31 and the second inner conductor 32.

The adapter 4 includes a third outer conductor 41, a third inner conductor 42, and two third insulators 43. The third inner conductor 42 may be coaxially arranged in the third outer conductor 41. The two third insulators 43 may be arranged at both ends of the third inner conductor 42 and sleeved on the outside of the third inner conductor 42. The third insulator 43 may be arranged between the third outer conductor 41 and the third inner conductor 42. The two ends of the third outer conductor 41 may be electrically connected to the first outer conductor 21 and the second outer conductor 31, respectively. The two ends of the third inner conductor 42 may be electronically connected to the first inner conductor 23 and the second inner conductor 32, respectively.

Figure 4:
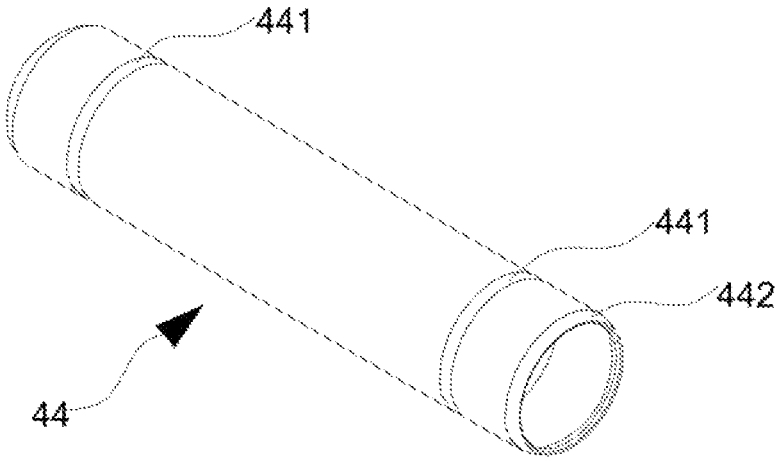
FIG. 4 is a schematic structural diagram of a fourth outer conductor according to some embodiments of the present disclosure.
Figure 5:
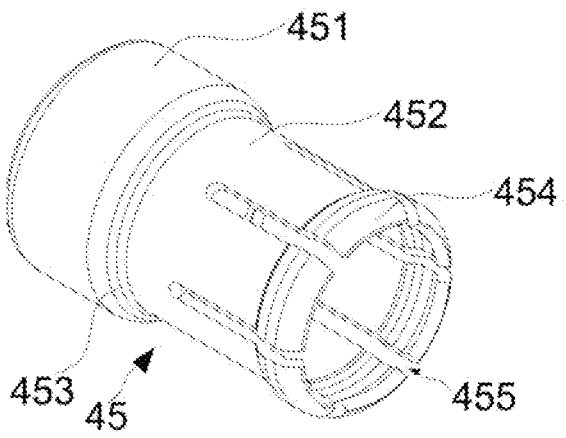
FIG. 5 is a schematic structural diagram of a fifth outer conductor according to some embodiments of the present disclosure.

As shown in FIG. 4 and FIG. 5, the third outer conductor 41 includes a fourth outer conductor 44 and two fifth outer conductors 45. The two outer conductors 45 may cover outsides of the two third insulator 43, respectively. The fourth outer conductor 44 includes a first end and a second end. The two fifth outer conductors 45 may be electrically connected to the first end and the second end, respectively. The fourth outer conductor 44 may be cylindrical and made of brass material. The fourth outer conductor 44 includes two first grooves 441 recessed inwardly from its outer circumferential surface. Both first grooves 441 extend in the circumferential direction and are arranged at the first end and the second end of the fourth outer conductor 44, respectively. Each of the first end and the second end of the fourth outer conductor 44 contracts inwardly to form a slope 442. The fourth outer conductor 44 may be formed by stretching a copper tube and primming process, that is, the fourth outer conductor 44 may be made by stretching a copper tube, and the first groove 441 may be made by a tube primming process. The first end of the fourth outer conductor 44 may be connected to one of the fifth outer conductors 45 and located at an outside of the corresponding fifth outer conductor 45, and one end of the corresponding fifth outer conductors 45 may abut against an outer wall of the first groove 441. The second end of the fourth outer conductor 44 may be connected to the other one of the fifth outer conductors 45 and located at an outside of the corresponding fifth outer conductor 45, and one end of the corresponding fifth outer conductor 45 may abut against an outer wall of the first groove 441. The first groove 441 may be configured to limit an installation position of the one of the fifth outer conductors 45, so that the one of the fifth outer conductors 45 may be installed at a correct position.

The fifth outer conductor 45 may be formed by punching and wrapping a material belt. The material belt may include a beryllium copper material belt. The structure of the fifth outer conductor 45 may have the effect of cost-saving and life extension. The fifth outer conductor 45 includes an end portion 451 and an extension portion 452. The end portion 451 may be connected to the fourth outer conductor 44 and located in the fourth outer conductor 44. The end portion 451 may abut against the outer wall of the first groove 441. The extension portion 452 may be located outside of the fourth outer conductor 44. The inner diameter of the extension portion 452 may be less than the inner diameter of the end portion 451. A first step 453 may be formed between the end portion 451 and the extension portion 452. The first step 453 may cooperate and contact with the slope 442 at the fourth outer conductor 44. The extension portion 452 can have a free end in a direction away from the end portion 451, and the end of the free end includes a protrusion 454. The protrusion 454 may contact a first outer conductor 21. A plurality of notches 455 are arranged at the end of the free end and extend in a direction toward the end portion 451. The elasticity of the extension portion 452 of the fifth outer conductor 45 may be increased by the arrangement of the notches 455 to satisfy the larger radial offset. In some embodiments, the radial offset of an example board-to-board connector is ±4°. The protrusion 454 may further strengthen the contact with the first outer conductor 21 when the fifth outer conductor 45 contacts the inner wall of the first outer conductor 21 of the clamping socket 2. The design of the notches 455 and the protrusion 454 may facilitate the installation of the fifth outer conductor 45 at the third insulator 43.

The first outer conductor 21 may contact the fifth outer conductor 45. The first outer conductor 21 includes an inner wall, and the inner wall is flat. The fifth outer conductor 45 may contact the inner wall so that there is an axial offset of ±1.2 mm between the clamping socket 2 and the adapter 4. Thus, the product may be caused to have functions of a large tolerance and low intermodulation. The sixth outer conductor 22 includes a guide surface 221 configured to guide the fifth outer conductor 45 to contact the inner wall of the first outer conductor 21.

Figure 6:
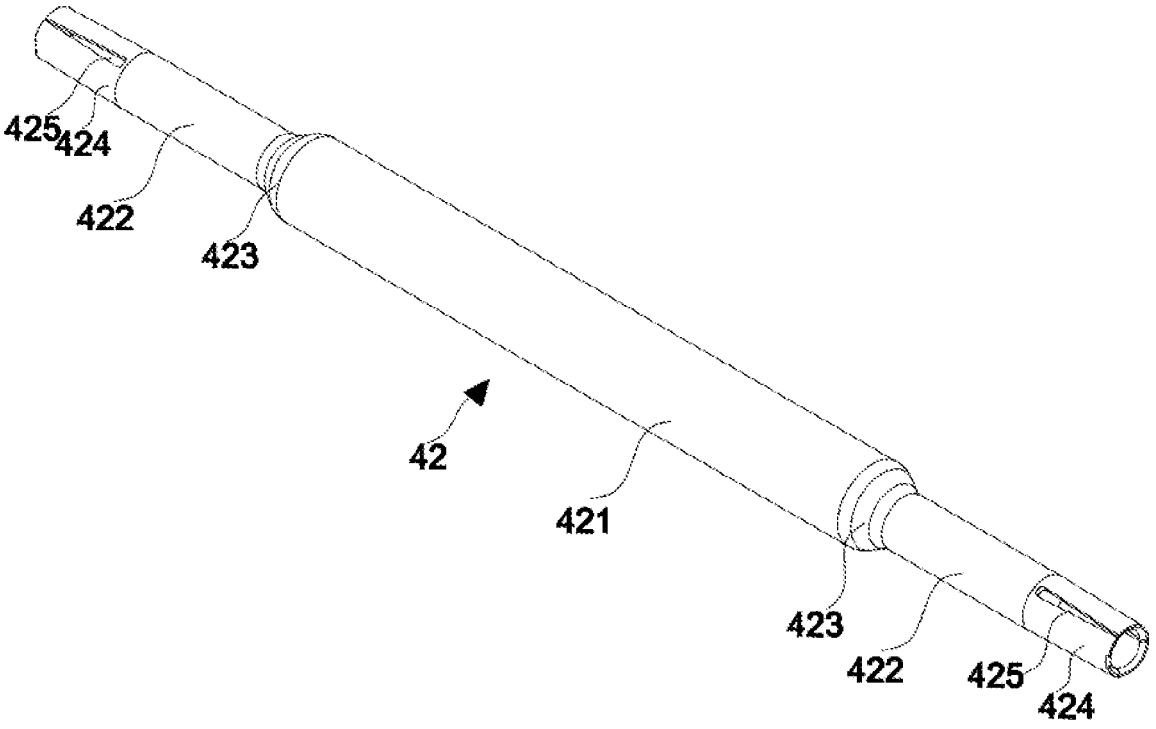
FIG. 6 is a schematic structural diagram of a third inner conductor according to some embodiments of the present disclosure.

As shown in FIG. 6, the third inner conductor 42 of the adapter 4 is hollow. The third inner conductor 42 may be formed by punching and wrapping a material belt. The third inner conductor 42 includes a middle portion 421 and two end parts 422. The inner diameters of the two end parts 422 may be less than the inner diameter of the middle portion 421. The structure may facilitate electroplating and cost-saving. The adapter 4 may further include two second steps 423. One second step 423 is arranged at a junction between the middle portion 421 and one of two end parts 422, and the other second step 423 is arranged at a junction between the middle portion 421 and the other of two end parts 422. The two third insulators 43 are sleeved on the two end parts 422, respectively. The two end parts 422 and the third insulator 43 are arranged coaxially. One end of the third insulator 43 may abut against the second step 423. The other end of the third insulator 43 protrudes from the two end parts 422 of the third inner conductor 42. That is, the arrangement of the second steps 423 may facilitate the cooperation and installation between the third inner conductor 42 and the third insulator 43. The second steps 423 may position the third insulator 43 to prevent the two end parts 422 of the third inner conductor 42 from contacting the first insulator 24 and the second insulator 33 to affect the intermodulation performance of the product/connector. Each of the two end parts 422 is provided with a tapered clamping portion 424. The tapered clamping portions 424 is configured to clamp the first inner conductor 23 and the second inner conductor 32, respectively. The tapered clamping portion 424 includes a plurality of cutouts 425. The cutouts 425 may cause the tapered clamping portion 424 to be more elastic. Moreover, the tapered clamping portions 424 may clamp the first inner conductor 23 and the second inner conductor 32 more firmly.

Figure 7:
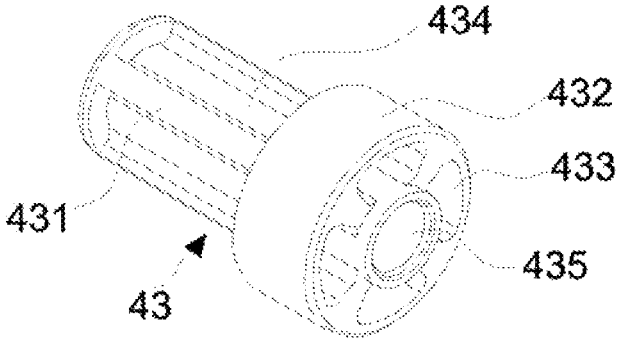
FIG. 7 is a schematic structural diagram of a third insulator according to some embodiments of the present disclosure.

As shown in FIG. 7, the third insulator 43 is formed by an injection molding process. The third insulator 43 includes a body portion 431 and an auxiliary portion 432 around the body portion 431. A plurality of first through-holes 433 may be arranged between the body portion 431 and the auxiliary portion 432. The body portion 431 includes a plurality of second grooves 434 recessed inwardly from the outer circumferential surface. The design may save cost and improve electrical performance. A second through-hole 435 may be arranged in the axial direction of the center of the body portion 431. The two end parts 422 of the third inner conductor 42 may be installed in the second through-hole 435, so that the third insulator 43 and the third inner conductor 42 may be arranged coaxially. As such, product lifetime and application performance may be improved while the cost may be saved.

The technical content and technical features of the present disclosure are disclosed as above. However, those skilled in the art may make various replacements and modifications based on the teachings and disclosures without departing from the spirit of the present disclosure. Therefore, the scope of the present disclosure should not be limited to the content disclosed in embodiments of the present disclosure but should include various replacements and modifications without departing from the scope of the present disclosure. The scope of the present invention should be covered by the claims of this patent application.

What is claimed is:

1. A board-to-board radio frequency coaxial connector, comprising:

an adapter;

a clamping socket arranged at a first end of the adaptor and including:

a first outer conductor;

a first inner conductor arranged coaxially in the first outer conductor; and a first insulator arranged between the first inner conductor and the first outer conductor; and a fixed socket arranged at a second end of the adaptor and including:

a second outer conductor;

a second inner conductor arranged coaxially in the second outer conductor; and a second insulator arranged between the second inner conductor and the second outer conductor;

wherein the adapter includes:

a third outer conductor;

a third inner conductor arranged coaxially in the third outer conductor; and two third insulators arranged at two ends of the third inner conductor, respectively, and sleeved on an outside of the third inner conductor, the two third insulators being arranged coaxially with the third inner conductor and between the third inner conductor and the third outer conductor, wherein each of the two third insulators includes:

a body portion and an auxiliary portion arranged around the body portion, wherein a first through-hole is arranged between the body portion and the auxiliary portion, a second groove recesses inwardly from an outer circumferential surface of the body portion, a second through-hole is arranged at a center of the body portion and extends axially to arrange the third inner conductor in the second through-hole, wherein:

two ends of the third outer conductor are electrically connected to the first outer conductor and the second outer conductor, respectively; and the two ends of the third inner conductor are electrically connected to the first inner conductor and the second inner conductor, respectively.

2. The board-to-board radio frequency coaxially connector of claim 1, wherein the third insulator is formed by an injection molding process.

3. The board-to-board radio frequency coaxially connector of claim 1, wherein the third outer conductor includes:

a fourth outer conductor including a first end and a second end; and two fifth outer conductors covering outsides of the two third insulators and being electrically connected to the first end and the second end, respectively.

4. The board-to-board radio frequency coaxially connector of claim 3, wherein:

the fourth outer conductor is cylindrical;

the fourth outer conductor includes a first groove recessed inwardly from an outer circumferential surface of the fourth outer conductor;

the first groove extends along a circumferential direction;

the fourth outer conductor is formed by stretching a copper tube;

the first groove is formed by a primming process; and the fourth outer conductor is made of brass.

5. The board-to-board radio frequency coaxially connector of claim 3, wherein the fifth outer conductor is formed by punching and wrapping a beryllium copper belt.

6. The board-to-board radio frequency coaxially connector of claim 1, wherein:

the third inner conductor is formed by punching and wrapping a beryllium copper belt;

the third inner conductor includes a middle portion and two end parts; and inner diameters of the two end parts are less than an inner diameter of the middle portion;

the two third insulators are sleeved on the two end parts, respectively;

the two end parts are coaxially arranged with the third insulator;

a second step is arranged at a junction between the middle portion and one of the two end parts; and an end of the third insulator abuts against the second step.

7. The board-to-board radio frequency coaxially connector of claim 6, wherein:

each of the two end parts is provided with a tapered clamping portion configured to clamp the first inner conductor and the second inner conductor, respectively.

8. The board-to-board radio frequency coaxially connector of claim 3, wherein:

the first outer conductor includes an inner wall;

the inner wall is flat; and the fifth outer conductor contacts the inner wall.

9. The board-to-board radio frequency coaxially connector of claim 8, wherein:

the clamping socket further includes a sixth outer conductor coaxially arranged at an outside of the first outer conductor; and the sixth outer conductor includes a guide surface configured to guide the fifth outer conductor to contact the inner wall of the first outer conductor.

10. The board-to-board radio frequency coaxially connector of claim 4, wherein the fifth outer conductor includes:

an end portion connected to the fourth outer conductor and located in the fourth outer conductor, the end portion abutting against an outer wall of the first groove; and an extension portion having a free end including a protrusion contacting the first outer conductor.

11. The board-to-board radio frequency coaxially connector of claim 10, wherein:

each of the first end and the second end of the fourth outer conductor contracts inwardly to form a slope;

an inner diameter of the extension portion is smaller than an inner diameter of the end portion;

a first step is formed at a junction between the end portion and the extension portion, wherein the first step cooperates with and contacts the slope.

* * * * *